US006270646B1

(12) United States Patent
Walton et al.

(10) Patent No.: US 6,270,646 B1
(45) Date of Patent: Aug. 7, 2001

(54) ELECTROPLATING APPARATUS AND METHOD USING A COMPRESSIBLE CONTACT

(75) Inventors: Erick Gregory Walton, Underhill; Dean S. Chung, Essex Junction; Lara Sandra Collins, Georgia, all of VT (US); William E. Corbin, Jr., Newburgh, NY (US); Hariklia Deligianni, Edgewater, NJ (US); Daniel Charles Edelstein, New Rochelle; James E. Fluegel, Rhinebeck, both of NY (US); Josef Warren Korejwa, Charlotte, VT (US); Peter S. Locke, Hopewell Junction, NY (US); Cyprian Emeka Uzoh, Milpitas, CA (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/473,909

(22) Filed: Dec. 28, 1999

(51) Int. Cl.[7] ..... C25D 5/22; C25D 5/06; C25D 17/00

(52) U.S. Cl. ..... 205/93; 205/98; 205/117; 205/118; 205/123; 205/157; 204/224 R

(58) Field of Search ..... 204/224 R; 205/118, 205/117, 143, 123, 98, 96, 95, 93, 157

(56) References Cited

U.S. PATENT DOCUMENTS

| | | | | |
|---|---|---|---|---|
| 1,739,657 | | 12/1929 | Shemitz . | |
| 4,159,934 | | 7/1979 | Kadija | 204/224 |
| 4,786,389 | | 11/1988 | Moffitt | 204/206 |
| 4,800,001 | | 1/1989 | Ott et al. | 204/15 |
| 5,024,735 | | 6/1991 | Kadija | 204/15 |
| 5,277,785 | | 1/1994 | Van Anglen | 205/117 |
| 5,807,165 | * | 9/1998 | Uzoh et al. | 451/41 |
| 6,004,880 | * | 12/1999 | Liu et al. | 438/692 |
| 6,030,550 | * | 2/2000 | Angelopoulos et al. | 252/500 |

* cited by examiner

*Primary Examiner*—Kathryn Gorgos
*Assistant Examiner*—Michael J Feely
(74) *Attorney, Agent, or Firm*—Jay H. Anderson

(57) ABSTRACT

A metal plating apparatus is described which includes a compressible member having a conductive surface covering substantially all of the surface of the substrate to be plated. The plating current is thereby transmitted over a wide area of the substrate, rather than a few localized contact points. The compressible member is porous so as to absorb the plating solution and transmit the plating solution to the substrate. The wafer and compressible member may rotate with respect to each other. The compressible member may be at cathode potential or may be a passive circuit element.

22 Claims, 5 Drawing Sheets

ELECTROPLATING APPARATUS AND METHOD USING A COMPRESSIBLE CONTACT

FIELD OF THE INVENTION

This invention relates to semiconductor processing, and more particularly to an apparatus and method for plating metals and/or alloys on resistive substrates.

BACKGROUND OF THE INVENTION

Electroplating of metals on a substrate is an important process in the manufacture of semiconductor devices. A conventional plating apparatus, known in the art as a "fountain plater," is shown schematically in FIG. 1. A semiconductor wafer 1 is connected to a cathode 2 by contact pieces 3, which hold the edge of the wafer and partially cover the front of the wafer near the edge. The wafer and a consumable anode 4 are immersed in a plating solution. Typically, a fluid flow is established in the plating solution from the anode to the cathode. An electrical circuit including a voltage source V and carrying a current I (also shown schematically in FIG. 1) is established between the cathode and anode. In addition, the cathode and wafer rotate with respect to the anode, to provide improved mass transport to the wafer surface.

In the semiconductor industry, there is a continuing trend to reduce the size of features on a wafer which must be plated. This in turn requires thinner seed layers, particularly in processes such as the "dual damascene" process. A reduced seed layer thickness causes the substrate to become more resistive, and furthermore causes greater nonuniformity in the thickness of the plated metal near point contacts to the wafer. In addition, the problem of nonuniformity of thickness across the wafer (that is, differences in metal deposition rates at different locations on the wafer) is exacerbated when thin plated deposits are required. Excess metal, deposited on field regions of the wafer and not in the features where plating is desired, is removed in a subsequent process. An increase in nonuniformity in the plating process requires an increase in excess metal deposition, leading to longer and more costly post-plating processing.

The use of plating contacts, covering portions of the front of the wafer, results in a number of processing problems. The plating contacts have metal deposited on their surfaces, particularly on the surface 3*a* exposed to the fluid flow from the anode. The areas of the wafer covered by the contacts are not plated, so that any chips including those areas are lost. In addition, the current density (and hence the metal deposition rate) varies with location on the wafer; the current density typically is higher at the wafer edge near the contacts. This in turn causes a buildup of excess metal on the edge chips, so that these chips suffer from electrical shorts even after the excess has been removed elsewhere on the wafer.

It will be appreciated that the wafer, in contact with the cathode as shown in FIG. 1, is a resistive element in the plating circuit. In particular, the seed layer on the surface of the wafer (on which plating is desired) may be characterized as a network of resistances in which the currents are not necessarily equal, so that the plating current density is non-uniform over the surface of the wafer. As the size of the features to be plated and the thickness of the seed layer both decrease, this non-uniformity is aggravated. Increasing the number of plating contacts improves the uniformity of the current density, but with the undesirable effects noted above.

Other types of plating contacts are well known in the art. For example, U.S. Pat. No. 1,739,657 describes a plating apparatus in which a porous material, soaked with a plating solution, makes contact with a cathodic workpiece. U.S. Pat. No. 5,277,785 describes applying a plating solution to the surface of a workpiece using a plastic brush. In these references, only a portion of the workpiece is contacted at any given time, and the problem of non-uniform current density across the workpiece is not addressed.

There remains a need for a plating apparatus in which the use of conventional wafer-edge plating contacts is avoided, and the uniformity of the plating process is improved. In particular, there is a need for a plating contact arrangement which takes into account the resistive properties of the workpiece, and which permits electrical contact with the entire surface of the workpiece.

SUMMARY OF THE INVENTION

The present invention addresses the above-described need by providing a plating apparatus for plating metal on a substrate (typically a semiconductor wafer), in which the electrical current density within the metal layer (including the seed layer and the plated metal) is more uniformly distributed across the wafer. In accordance with the present invention, this is done by providing a porous, compressible member between the wafer and the anode. The compressible member has a conductive surface covering substantially all of the substrate surface to be plated, so that the electrical plating current is thereby transmitted to the substrate. Since the compressible member is porous, it absorbs the plating solution and transmits the plating solution to the substrate. The surface of the substrate to be plated typically comprises a seed layer; the compressible member is in electrical contact with substantially all of the seed layer. The conductive surface may be formed of a polyaniline material.

A separation distance may be maintained between the substrate and the compressible member; this distance is controlled (for example, by moving the compressible member) to permit movement of the substrate with respect to the compressible member during a plating operation while maintaining electrical contact therewith. Specifically, a thin layer of plating solution may separate the wafer from the compressible member, so that the wafer may move relative to the compressible member without damage to structures on the wafer.

The plating apparatus may advantageously include a means for injecting a plating additive into the compressible member. As explained in more detail below, the plating process is improved by using a plating additive which inhibits plating at a certain location on the wafer, in accordance with a separation distance between the conductive surface of the compressible member and the wafer at that location.

It is desirable that the compressible member have vents for venting air, so that plating solution can be delivered reliably from the compressible member to the wafer.

In accordance with one aspect of the invention, the plating apparatus includes a cathode having a cathode potential in electrical contact with the substrate, and the conductive surface of the compressible member is at the cathode potential. In accordance with another aspect of the invention, the compressible member is not at the cathode potential in the circuit carrying the plating current.

According to an additional aspect of the invention, the plating apparatus includes an anode, and the compressible member is not at the cathode potential, but is in contact with the anode. The anode may have a plurality of holes formed therein to conduct the plating solution to the compressible member.

According to a further aspect of the invention, a method of plating metal on a surface of a substrate is provided, using the above-described plating apparatus. Specifically, this method includes the steps of providing a compressible member having a conductive surface covering substantially all of the surface of the substrate, the member being porous so as to absorb the plating solution; transmitting the plating current from the compressible member to the surface of the substrate through the conductive surface; and allowing the plating solution to be transmitted from the compressible member to the substrate.

DETAILED DESCRIPTION OF THE PREFERRED EMBODIMENTS

Figure 2:
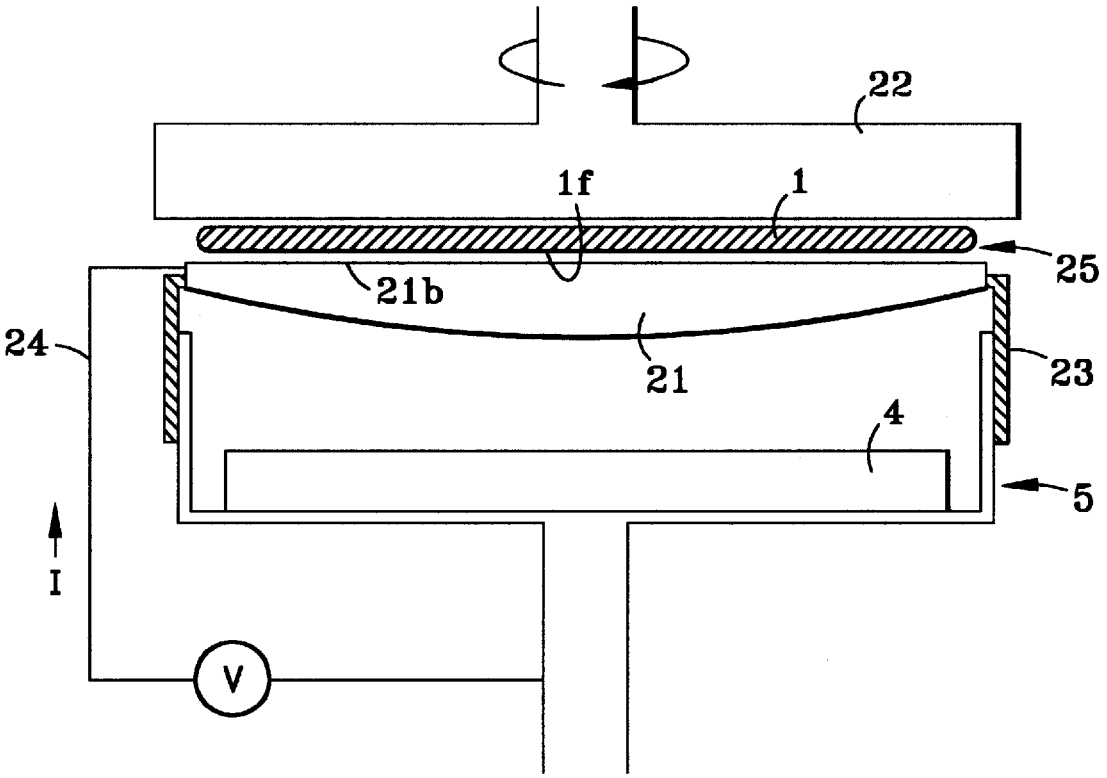
FIG. 2 is a schematic illustration of a plating cell according to a first embodiment of the present invention, wherein a sponge in contact with the wafer is used to deliver the plating solution and electrical current to the wafer.

A first embodiment of the present invention is shown schematically in FIG. 2. The wafer 1, instead of being connected to the cathode by plating contacts, is held against a rotating head 22 using a vacuum chuck (not shown). A porous, compressible, electrically conductive member 21 (hereinafter simply called a sponge) is held close to the wafer 1. The sponge is made of an elastomer or polymer, and is supported by a non-conductive (e.g. plastic) support 23 which is connected to the anode assembly 5. Alternatively, the current-carrying wire 24 (shown schematically in FIG. 2) may be configured as a wire mesh (preferably either Ti or stainless steel) to provide mechanical support for the sponge 21. In this embodiment, the head 22 and wafer 1 rotate with respect to the sponge 21, to improve mass transport of species within the plating solution.

It will be appreciated that no plating takes place on the surface of the sponge, and that the back surface of the wafer is protected from plating by the vacuum chuck. Metal contamination of the back surface of the wafer is thereby prevented.

Since at least the wafer 1, sponge 21 and anode 4 are immersed in the plating solution, the sponge 21 is filled with plating solution. The gap 25 between the sponge and the wafer (also filled with plating solution) is adjusted to permit relative motion between the wafer 1 and sponge 21, while maintaining electrical contact between the seed layer on the front surface 1*f* of the wafer and the back surface 21*b* of sponge 21. The sponge may easily be adjusted relative to the wafer by moving the support 23 up or down relative to the anode assembly.

Figure 2A:
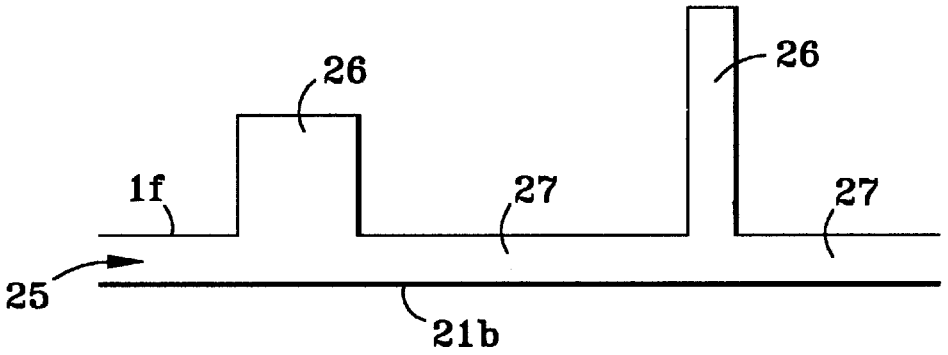
FIG. 2A is a detail view showing surface features of the wafer filled with the plating solution and in proximity to the sponge.

The sponge is maintained in full plating contact (discussed in more detail below) with the wafer while at a distance from the wafer such that the sponge can hydroplane on the surface 1*f* of the wafer as the wafer rotates. The plating fluid in the gap 25 may thus be characterized as a hydrodynamic layer, whose thickness depends upon the topography of the wafer surface. For example, as shown in FIG. 2A, trench structures in the wafer filled with the plating solution and would therefore be locally thick portions 26 of the hydrodynamic layer.

Figure 1:
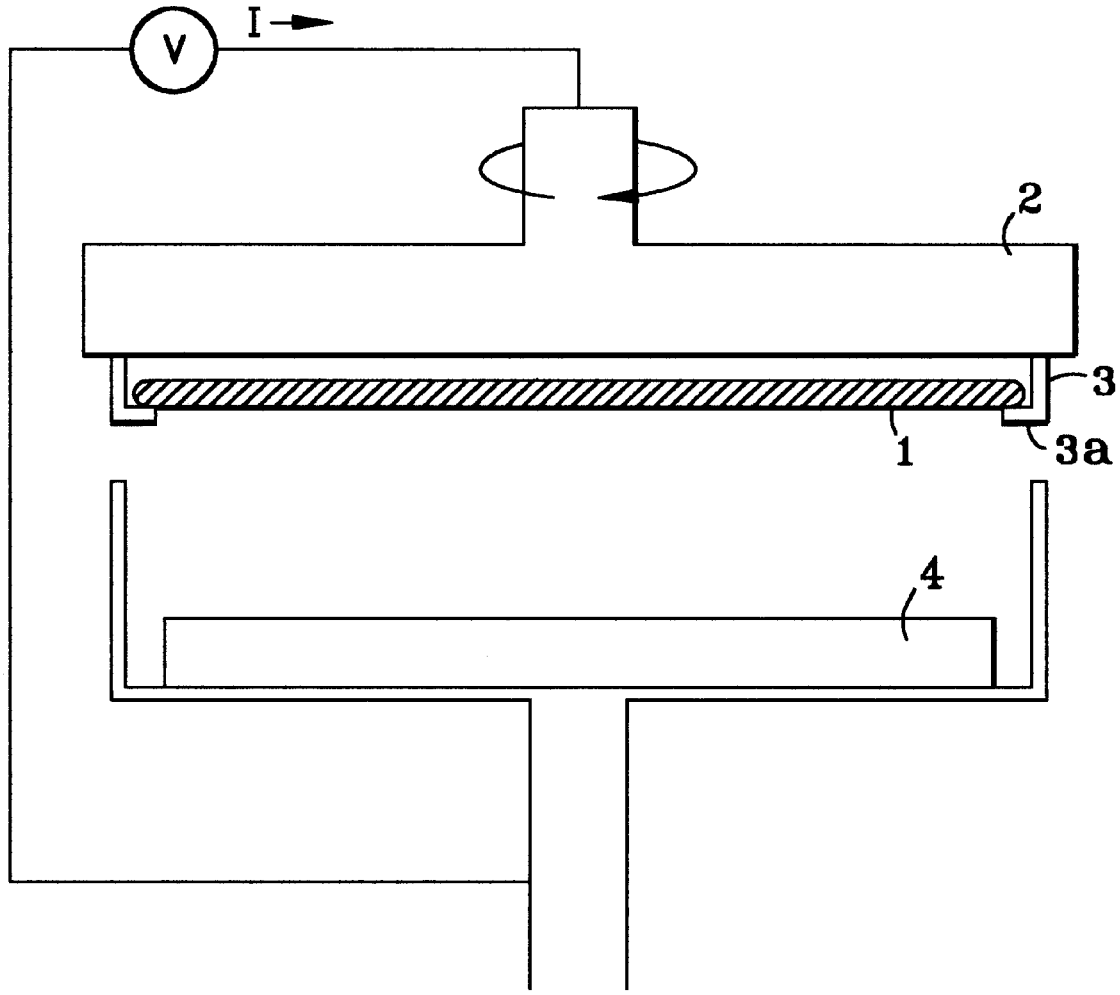
FIG. 1 PRIOR ART
FIG. 1 is a schematic illustration of a conventional arrangement of a plating cell, including plating contacts for holding the wafer to the cathode.

As can be seen in FIG. 2, the surface 21*b* of the sponge is at cathode potential, which is applied to the full surface area of the seed layer on the surface 1*f* of the wafer. The surfaces 1*f* and 21*b* of the wafer and sponge may be viewed as a resistive layer and an electroactive contact layer, respectively, with depressions or cavities in the resistive layer filled with plating solution. Accordingly, electrons are effectively injected into the seed layer, so that plating proceeds efficiently. It should be noted that with this arrangement, the entire seed layer is in contact with a surface at cathodic potential, as opposed to selected areas at the wafer edge as in the arrangement of FIG. 1.

As indicated above, it is vital that the material of the back surface 21*b* of the sponge (1) be capable of carrying DC (or AC) current, and (2) be able to move relative to the wafer while in contact therewith, without damaging the seed layer or plated layer; the latter requirement is especially stringent when a soft metal such as copper is being plated. One suitable material is ORMECON Incofilm G300-D9, available from Ormecon Chemie GmbH, Ammersbek, Germany (a subsidiary of Zipperling Kessler & Co.). This material is a polyester film coated with a thin layer of ORMECON, a conducting polyaniline. The conductivity of the ORMECON coating is on the order of 100 reciprocal ohm-cm. It will be appreciated that, since the entire surface area of the seed layer on the wafer is in electrical contact with the material, the current density which must be supported by the material is far less than that carried by conventional plating contacts. The current density in the arrangement of FIG. 2 is typically on the order of 10 $mA/cm^2$, but may be in the range of 0.1 $mA/cm^2$ to about 150 $mA/cm^2$, depending on the application; for example, a pulsed plating process generally has a current density greater than 100 $mA/cm^2$.

Figure 3A:
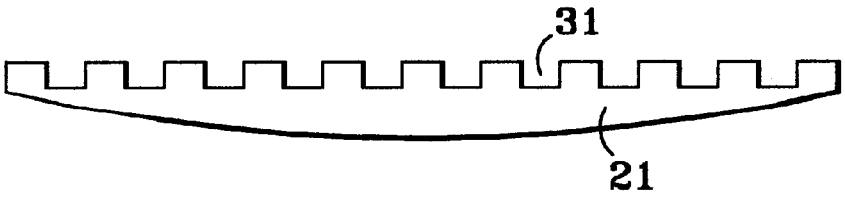
FIGS. 3A, 3B and 3C show possible variations in the shape and composition of the sponge used in the present invention.
Figure 3B:
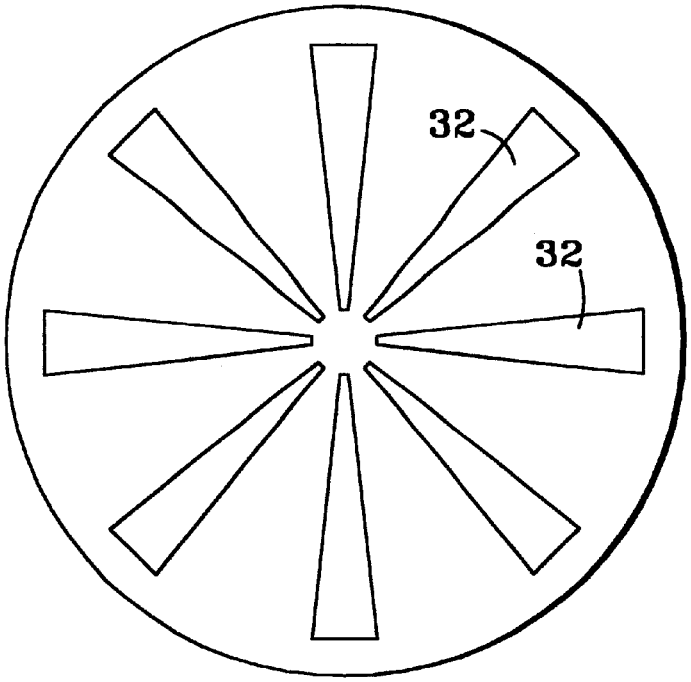

It is also important that the sponge be capable of venting air bubbles. The sponge may be dome-shaped as shown in FIG. 2, to increase the surface area not covered by the wafer. The sponge may also be fabricated with holes or grooves to channel air to the outside edge of the sponge, where it can be vented (for example, as shown in FIG. 3A, where straight grooves 31 run across the back surface of the sponge). Alternatively, the sponge may have cavities 32 oriented in the radial direction, as shown in FIG. 3B.

The mechanical contact between the sponge 21 and the wafer 1 can be controlled by moving or flexing the sponge. Specifically, the distance between wafer and sponge can be controlled by mechanically moving the sponge support 23 up or down. The sponge may also be mechanically flexed, for example by tightening or loosening a ring around the circumference of the sponge 21 or surrounding the support 23. The sponge can also be made to flex by increasing the pressure or flow of plating solution from the anode to the cathode.

Figure 3C:
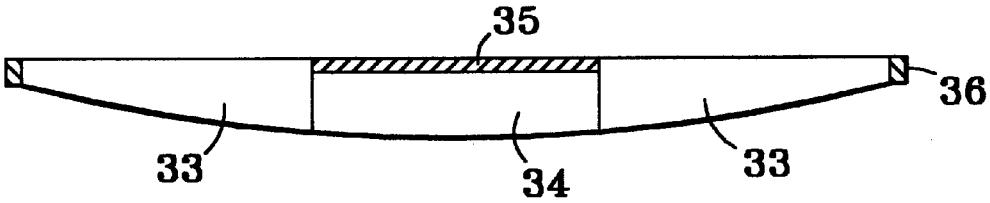

In certain plating applications it may be desirable to control the distribution and density of current. This may be done by altering the structure or composition of the sponge 21. For example, as shown schematically in FIG. 3C, the sponge may be composed of two or more sections 33, 34 having different porosity, or the sponge may be fabricated so that its porosity varies continuously in the radial direction. One or more additional conducting layers 35 may be added to the sponge to change its electrical conductivity at a particular location. The current density may be controlled by adding an insulator 36 at the edge of the sponge.

Figure 4:
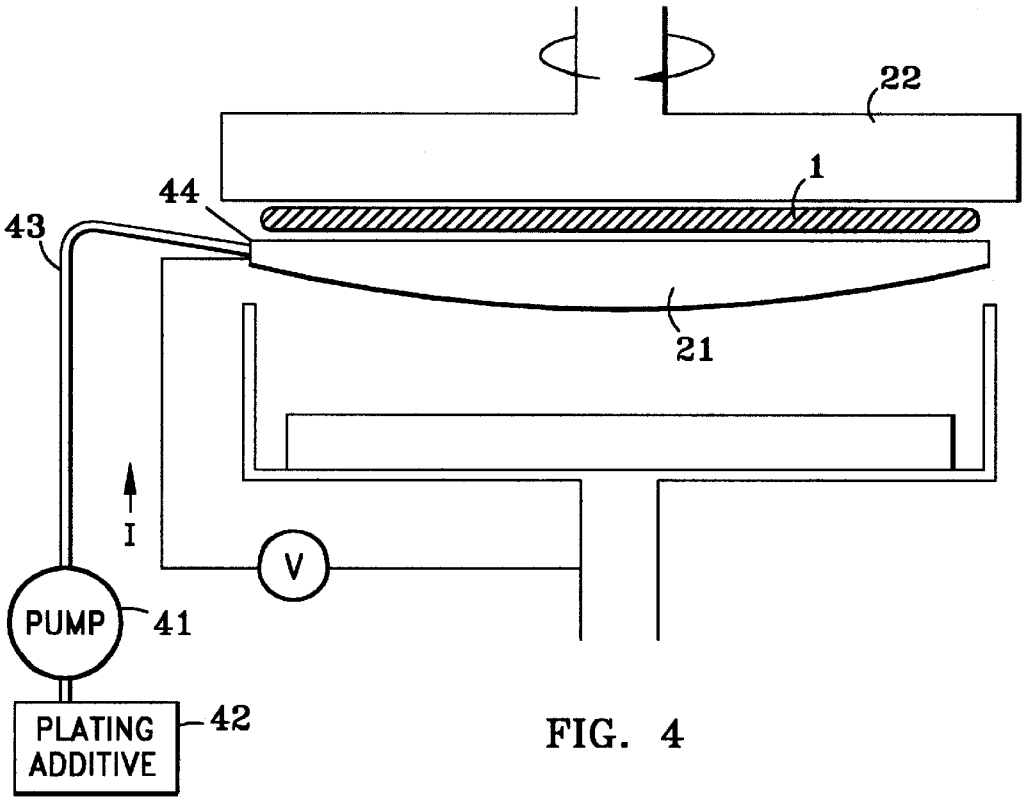
FIG. 4 shows a variation of the arrangement of FIG. 2, wherein a plating additive is injected into the sponge.

The use of a sponge in contact with the entire seed layer on the front surface of the wafer also permits concentrated plating additives to be introduced at the wafer surface, as shown schematically in FIG. 4. This is also referred to as "point-of-use dopant spiking." A pump 41 causes the plating additive to flow from a reservoir 42 through a feed tube 43 to one or more injection points 44 and into the sponge 21. The additive may be injected directly into the body of the sponge, or alternatively may be fed into a manifold imbedded in the sponge.

The plating additives may be used to enhance the plating rate on areas of the wafer where metal is desired, and to suppress plating in other areas. For example, FIG. 2A shows trench or via areas where plating is desired, separated by field areas. The hydrodynamic layer between the sponge surface 21*b* and the wafer surface 1*f* is thicker in the trench/via areas of the wafer than in the field areas. A plating additive designed to inhibit plating would tend to be transported more slowly in the thicker area 26 than in the thinner area 27. This tendency could be further enhanced by doping the surface 21*b* of the sponge with a chemical species which inhibits plating where the sponge and wafer are in more intimate contact, namely at the field regions of the wafer.

Figure 5:
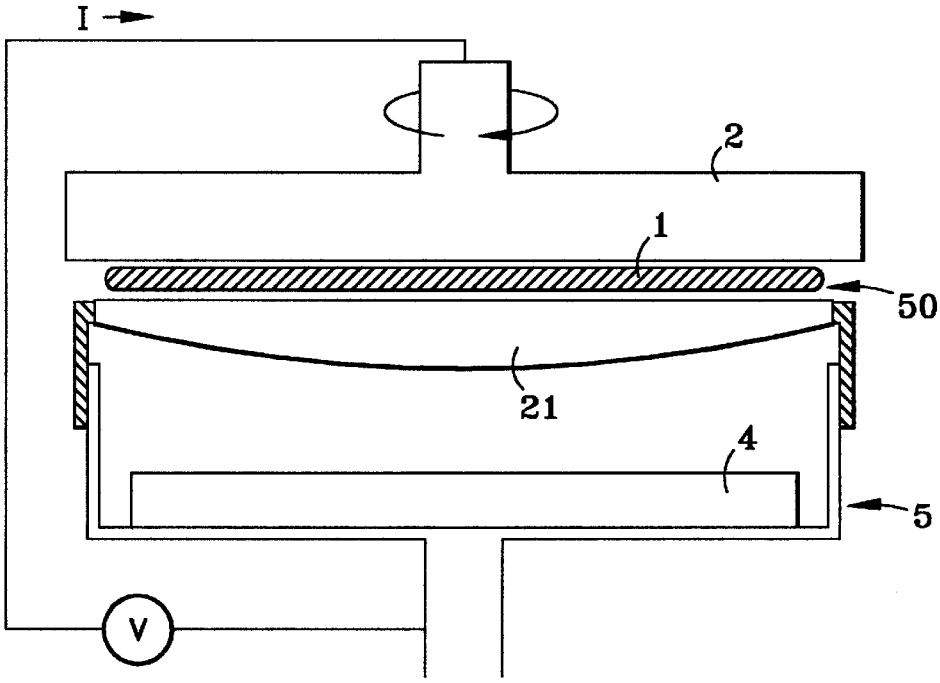
FIG. 5 is a schematic illustration of an additional embodiment of the present invention, in which a sponge is a passive element in the electrical plating circuit.

An additional embodiment of the invention is shown in FIG. 5. In this embodiment, the sponge 21 is not at the cathode potential, but it interposed between the cathode 2 and anode 4. As in the first embodiment, the sponge 21 is held in electrical contact with the entire front surface of the wafer and permits diffusion of the plating solution through the body of the sponge. The plating solution in the gap 50 between the wafer 1 and the sponge 21 forms a thin hydrodynamic layer which permits the wafer to rotate relative to the sponge.

Figure 6:
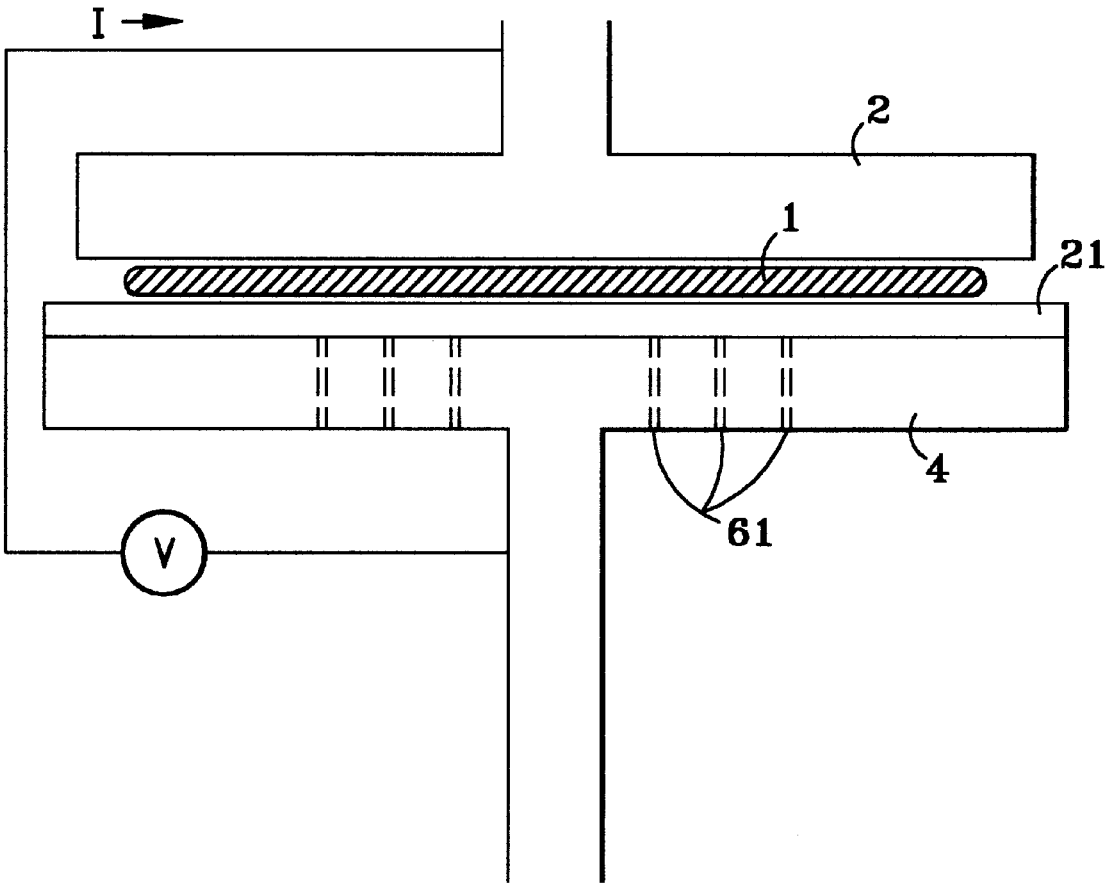
FIG. 6 is a schematic illustration of an alternate arrangement of the embodiment of FIG. 5.

A variation of the structure of this embodiment is shown in FIG. 6. In this arrangement, the wafer 1, cathode 2, sponge 21 and anode 4 are held together in a sandwich structure which is immersed in the plating solution. The cathode 2 and wafer 1 may rotate with respect to the sponge 21 (a hydrodynamic layer being formed between the wafer and sponge, as described previously). The sponge 21 preferably includes a layer of conducting polyaniline in contact with the wafer, as in the foregoing embodiments. The anode has a multiplicity of small holes 61 to permit the plating solution to reach the sponge and then the wafer. The fluid pressure and flow rate of the plating solution may be controlled by varying (for example) the sponge material, the sponge thickness, or the speed of wafer rotation. Plating additives could also be injected into the sponge as described above with reference to FIG. 4.

The use of a compressible, electrically conductive plating contact permits delivery of the plating solution to the front surface of the wafer with a uniform (or controlled distribution) current density, while avoiding the problems associated with conventional plating contacts.

While the invention has been described in terms of specific embodiments, it is evident in view of the foregoing description that numerous alternatives, modifications and variations will be apparent to those skilled in the art. Accordingly, the invention is intended to encompass all such alternatives, modifications and variations which fall within the scope and spirit of the invention and the following claims.

We claim:

1. A plating apparatus using a plating solution and an electrical plating current for plating metal on a surface of a substrate, the apparatus comprising:

a plating solution, a compressible member and a substrate immersed in said plating solution, said compressible member having a conductive surface covering said surface of the substrate and thereby transmitting the plating current thereto, the compressible member being porous so as to absorb the plating solution and transmit the plating solution to the substrate, the plating solution and the compressible member being arranged so as to avoid damage to metal plated on the surface of the substrate.

2. A plating apparatus according to claim 1, wherein the surface of the substrate comprises a seed layer on which the plating is performed, and the compressible member is in electrical contact with the seed layer.

3. A plating apparatus according to claim 1, wherein the plating apparatus includes a cathode having a cathode potential in electrical contact with the substrate, and the conductive surface of the compressible member is at the cathode potential.

4. A plating apparatus according to claim 1, further comprising means for controlling a separation distance between the substrate and the compressible member, to permit movement of the substrate with respect to the compressible member during a plating operation while maintaining electrical contact therewith.

5. A plating apparatus according to claim 1, further comprising means for injecting a plating additive into the compressible member.

6. A plating apparatus according to claim 5, wherein the plating additive inhibits plating at a location on the substrate, in accordance with a separation distance between the conductive surface of the compressible member and said location.

7. A plating apparatus according to claim 1, wherein the compressible member has vents for venting air therefrom.

8. A plating apparatus according to claim 1, wherein the plating current is in an electrical circuit, and the compressible member is not at the cathode potential in that circuit.

9. A plating apparatus according to claim 1, wherein the plating apparatus includes an anode, and the compressible member is in contact with the anode.

10. A plating apparatus according to claim 9, wherein the anode has a plurality of holes formed therein to conduct the plating solution to the compressible member.

11. A plating apparatus according to claim 1, wherein the conductive surface is formed of a polyaniline material.

12. A method of plating metal on a surface of a substrate, the plating being performed using a plating solution and an electrical plating current, the method comprising the steps of:

providing a plating solution, providing a compressible member having a conductive surface covering said surface of the substrate, the compressible member being porous so as to absorb the plating solution;

immersing said compressible member and said substrate in said plating solution, transmitting the plating current from the compressible member to said surface of the substrate through the conductive surface; and allowing the plating solution to be transmitted from the compressible member to the substrate, so as to avoid damage to metal plated on the surface of the substrate.

13. A method according to claim 12, wherein the surface of the substrate comprises a seed layer on which the plating is performed, and the compressible member is in electrical contact with the seed layer.

14. A method according to claim 12, further comprising the step of providing a cathode having a cathode potential in electrical contact with the substrate, wherein the conductive surface of the compressible member is at the cathode potential.

15. A method according to claim 12, further comprising the step of controlling a separation distance between the substrate and the compressible member, to permit movement of the substrate with respect to the compressible member during a plating operation while maintaining electrical contact therewith.

16. A method according to claim 12, further comprising the step of injecting a plating additive into the compressible member.

17. A method according to claim 16, wherein the plating additive inhibits plating at a location on the substrate, in accordance with a separation distance between the conductive surface of the compressible member and said location.

18. A method according to claim 12, wherein the step of providing the compressible member further comprises providing vents in the compressible member for venting air therefrom.

19. A method according to claim 12, further comprising the steps of providing an electrical circuit for the plating current, and wherein the compressible member does not actively apply potential to said surface of the substrate in that circuit.

20. A method according to claim 12, wherein the plating is performed using an anode, and further comprising the step of contacting the compressible member to the anode.

21. A method according to claim 20, further comprising the step of providing a plurality of holes in the anode to conduct the plating solution to the compressible member.

22. A method according to claim 12, wherein the conductive surface is formed of a polyaniline material.

* * * * *